US007104768B2

(12) United States Patent
Richter et al.

(10) Patent No.: US 7,104,768 B2
(45) Date of Patent: Sep. 12, 2006

(54) PERISTALTIC MICROPUMP

(75) Inventors: Martin Richter, Munich (DE); Martin Wackerle, Tegernau (DE); Yücel Congar, Kerpen (DE); Julia Nissen, Munich (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 147 days.

(21) Appl. No.: 10/960,549

(22) Filed: Oct. 6, 2004

(65) Prior Publication Data

US 2005/0123420 A1 Jun. 9, 2005

Related U.S. Application Data

(63) Continuation of application No. PCT/EP03/09352, filed on Aug. 22, 2003.

(30) Foreign Application Priority Data

Aug. 22, 2002 (DE) ..... 102 38 600

(51) Int. Cl.
*F04B 17/00* (2006.01)

(52) U.S. Cl. ..... 417/423.2; 417/413.2; 417/413.3

(58) Field of Classification Search ..... 417/413.1, 417/413.2, 413.3
See application file for complete search history.

(56) References Cited

U.S. PATENT DOCUMENTS 5,259,737 A * 11/1993 Kamisuki et al. ..... 417/322
5,593,290 A 1/1997 Greisch et al. ..... 417/478
6,074,178 A 6/2000 Bishop et al. ..... 417/322

FOREIGN PATENT DOCUMENTS

| | | |
|---|---|---|
| DE | 196 37 928 | 9/1996 |
| DE | 197 19 862 | 5/1997 |
| EP | 949 418 | 10/1999 |
| WO | WO 87/07218 | 12/1987 |
| WO | WO 00/28213 | 5/2000 |

OTHER PUBLICATIONS

Cao, L., S. Mantell, and D. Polla; Design and simulation of an implantable medical drug delivery system using microelectromechanical systems technology; Jun. 12, 2001.

* cited by examiner

*Primary Examiner*—Tae Jun Kim
*Assistant Examiner*—Samuel E. Belt
(74) *Attorney, Agent, or Firm*—Michael A. Glenn; Glenn Patent Group

(57) ABSTRACT

A Peristaltic micropump includes a first membrane region with a first piezo-actor for actuating the first membrane region, a second membrane region with a second piezo-actor for actuating a second membrane region, and a third membrane region with a third piezo-actor for actuating the third membrane region. A pump body forms, together with the first membrane region, a first valve whose passage opening is open in the non-actuated state of the first membrane region and whose passage opening may be closed by actuating the first membrane region. The pump body forms, together with the second membrane region, a pumping chamber whose volume may be decreased by actuating the second membrane region. The pump body forms, together with the third membrane region, a second valve whose passage opening is open in the non-actuated state of the third membrane region and whose passage opening may be closed by actuating the third membrane region. The first and the second valve are fluidically connected to the pumping chamber.

18 Claims, 10 Drawing Sheets

PERISTALTIC MICROPUMP

CROSS-REFERENCE TO RELATED APPLICATION

This application is a continuation of co-pending International Application No. PCT/EP03/09352, filed Aug. 22, 2003, which designated the United States and was not published in English and is incorporated herein by reference in its entirety.

BACKGROUND OF THE INVENTION

1. Field of the Invention

The present invention relates to a micropump, and in particular a micropump working according to a peristaltic pumping principle.

2. Description of the Related Art

Micropumps working according to a peristaltic pumping principle are known from the prior art. The article "Design and simulation of an implantable medical drug delivery system using microelectromechanical systems technology", by Li Cao et al., Sensors and Actuators, A94 (2001), pages 117 to 125, deals with a peristaltic micropump comprising an inlet, three pumping chambers, three silicon membranes, three normally closed active valves, three piezo-stack actuators of PZT, microchannels between the pumping chambers, and an outlet. The three pumping chambers are of the same size and are etched into a silicon wafer.

From WO 87/07218 a peristaltic micropump is also known, which has three membrane regions in a continuous substrate area. In a supporting layer supporting the substrate and an associated backing layer, a pumping channel is formed that is in connection with a fluid supply. In the pumping channel, in the region of an inlet valve and an outlet valve, a transverse rib is formed on which an associated membrane portion rests in the non-actuated state to close the inlet valve and the outlet valve in the non-actuated state. Between the separately actuatable membrane regions associated with the inlet valve and the outlet valve, the third membrane region, which may also be actuated separately, is arranged. By actuating the third membrane region, the chamber volume between the two valve regions is increased. Thus, by a corresponding timing of the three membrane regions, a peristaltic pumping effect between inlet valve and outlet valve may be achieved. According to WO 87/07218, the actor element consists of a composite of three elements comprising metal membrane, continuous ceramic layer, and segmented electrode arrangement. The ceramic layer has to be polarized in a segmented manner, which is technically difficult. Such a segmented piezo-bending element thus is expensive and allows only small stroke volumes, so that such a pump cannot work in a bubble-tolerant and self-priming manner.

From DE 19719862 A1, a micromembrane pump not working based on the peristaltic principle is known, wherein a pumping membrane adjoining a pumping chamber may be actuated by a piezo-actor. A fluid inlet and a fluid outlet of the pumping chamber are each provided with passive check valves. According to this document, the compression ratio of the micropump, i.e. the ratio of stroke volume of the pumping membrane to overall pumping chamber volume, is adjusted depending on the maximum pressure value depending on the valve geometry and the valve wetting, which is necessary to open the valves, to enable a bubble-tolerant, self-priming operation of the micromembrane pump there.

Apart from the above-mentioned piezo-actors, it would also be possible to realize micropumps using electrostatic actors, wherein electrostatic actors, however, only enable very small strokes. Alternatively, the realization of pneumatic drives would be possible, which, however, necessitates high expenditure regarding external pneumatics as well as the switching valves required for this. decreased by moving the second membrane region also towards the pump body.

Through this construction, the inventive peristaltic micropump enables the realization of bubble-tolerant, self-priming pumps, even if piezo-elements arranged on the membrane are used as piezo-actor. Alternatively, according to the invention, so-called piezo-stacks may also be used as piezo-actors, which are, however, disadvantageous as opposed to piezo-membrane converters in that they are large and expensive, provide problems with respect to the connection technique between stack and membrane and problems with the adjustment of the stacks, and are thus all in all connected with higher expenditure.

In order to ensure that the inventive peristaltic micropump can work in a bubble-tolerant and self-priming manner, it is preferably dimensioned such that the ratio of stroke volume and dead volume is greater than the ratio of delivery pressure (feed pressure) and atmospheric pressure, wherein the stroke volume is the volume displaceable by the pumping membrane, the dead volume is the volume remaining between inlet opening and outlet opening of the micropump, when the pumping membrane is actuated and one of the valves is closed and one is open, the atmospheric pressure is a maximum of about 1050 hPa (worst case consideration), and the delivery pressure is the pressure necessary in the fluid chamber region of the micropump, i.e. in the pressure chamber, to move a liquid/gas interface past a place representing a flow constriction (bottleneck) in the microperistaltic pump, i.e. between the pumping chamber and the passage opening of the first or the second valve, including this passage opening.

If the ratio of stroke volume and dead volume, which may be referred to as compression ratio, satisfies the above condition, it is ensured that the peristaltic micropump works in a bubble-tolerant and self-priming manner. This Pneumatic drives thus represent expensive, costly and space-intensive methods to implement membrane deflection.

SUMMARY OF THE INVENTION

It is the object of the present invention to provide a peristaltic micromembrane pump which is easily constructed and which enables a bubble-tolerant self-priming operation.

In accordance with a first aspect, the present invention provides a peristaltic micropump, having a first membrane region with a first piezo-actor for actuating the first membrane region; a second membrane region with a second piezo-actor for actuating the second membrane region; a third membrane region with a third piezo-actor for actuating the third membrane region; and a pump body, wherein the pump body forms, together with the first membrane region, a first valve whose passage opening is open in the non-actuated state of the first membrane region and whose passage opening may be closed by actuating the first membrane region, wherein the pump body forms, together with the second membrane region, a pumping chamber whose volume may be decreased by actuating the second membrane region, and wherein the pump body forms, together with the third membrane region, a second valve whose passage opening is open in the non-actuated state of the third membrane region and whose passage opening may be closed by actuating the third membrane region, wherein the first and second valves are fluidically connected to the pumping chamber.

The present invention thus provides a peristaltic micropump, wherein the first and second valves are open in the non-actuated state, and wherein the first and second valves may be closed by moving the membrane towards the pump body, whereas the volume of the pumping chamber may be applies for both employment of the peristaltic micropump for conveying fluids, when a gas bubble, normally an air bubble, reaches the fluid region of the pump, and the employment of the inventive micropump as a gas pump, when moisture unintentionally condenses from the gas to be conveyed, and thus a gas/liquid interface may occur in the fluid region of the pump.

Compression ratios satisfying the above condition may for example be inventively realized by embodying the volume of the pumping chamber greater than that of valve chambers formed between the respective valve membrane regions and opposing pump body sections. In preferred embodiments, this may be realized by the distance between membrane and surface and pump chamber surface in the region of the pumping chamber being greater than in the region of the valve chambers.

A further increase of the compression ratio of an inventive peristaltic micropump may be achieved by adapting the contour of a pumping chamber structured in the pump body to the bend line of the pumping membrane, i.e. the bend contour thereof in the actuated state, so that the pumping membrane may substantially displace the entire volume of the pumping chamber in the actuated state. Furthermore, the contours of valve chambers formed in the pump body may also be correspondingly adapted to the bend line of the respective opposing membrane sections, so that in the optimum case the actuated membrane region substantially displaces the entire valve chamber volume in the closed state.

BRIEF DESCRIPTION OF THE DRAWINGS

These and other objects and features of the present invention will become clear from the following description taken in conjunction with the accompanying drawings, in which.

DESCRIPTION OF THE PREFERRED EMBODIMENTS

Figure 1:
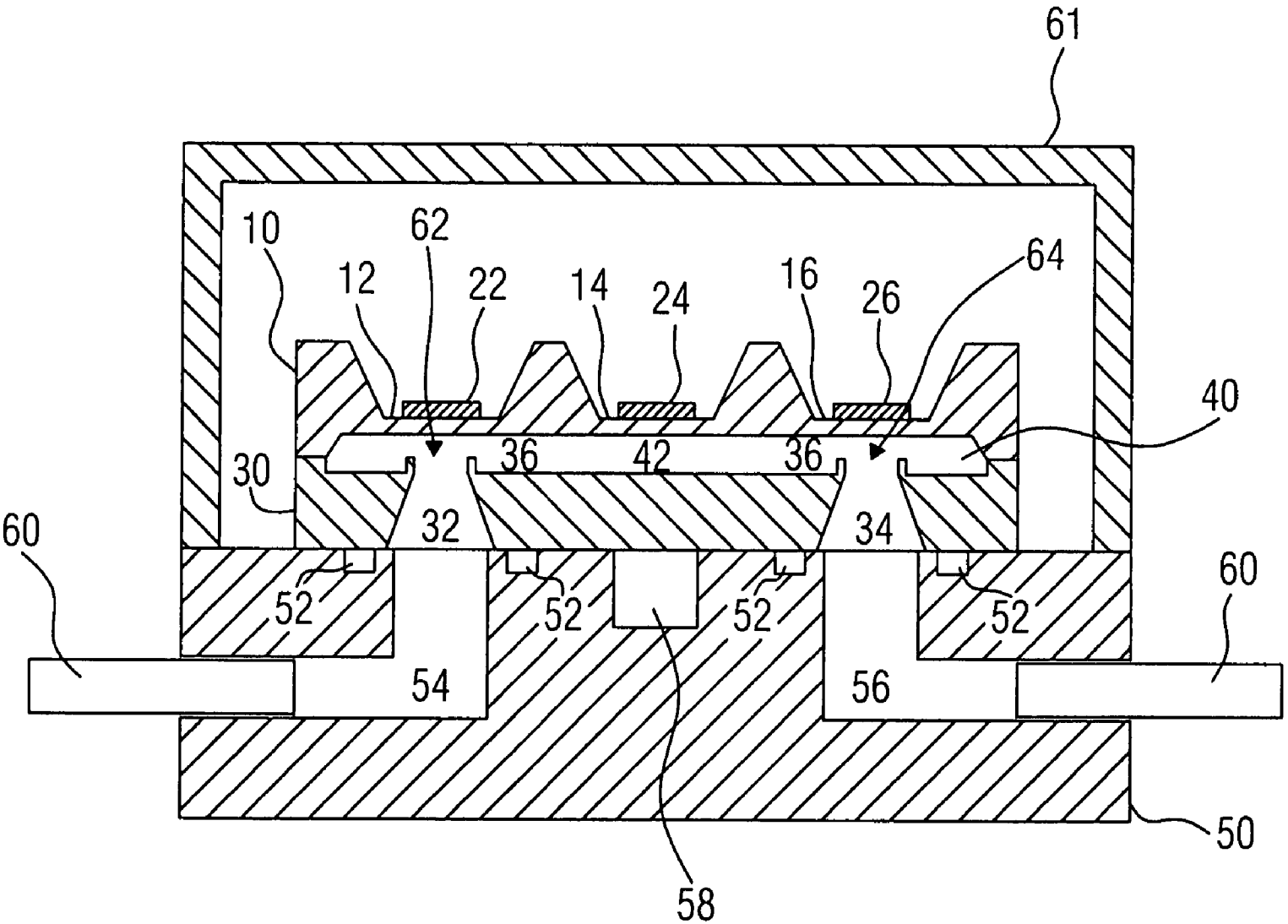
FIG. 1 is a schematic cross-sectional view of an embodiment of an inventive peristaltic micropump in a fluid system.

A first embodiment of an inventive peristaltic micropump integrated in a fluid system is shown in FIG. 1. The micromembrane pump includes a membrane element 10 having three membrane sections 12, 14, and 16. Each of the membrane sections 12, 14, and 16 is provided with a piezo-element 22, 24, and 26, respectively, and forms a piezo-membrane converter together therewith. The piezo-elements 22, 24, 26 may be glued on the respective membrane sections or may be formed on the membrane by a screen print or other thick film techniques.

The membrane element is circumferentially joint to a pump body 30 at outer regions thereof, so that there is a fluid-tight connection between them. In the pump body 30 two fluid passages 32 and 34 are formed, one of which, according to pumping direction, represents a fluid inlet and the other a fluid outlet. In the embodiment shown in FIG. 1, the fluid passages 32, 34 are each surrounded by a sealing lip 36.

Furthermore, in the embodiment shown in FIG. 1, the bottom side of the membrane element 10 and the top side of the pump body 30 are structured to define a fluid chamber 40 between them.

In the embodiment shown, both the membrane element 10 and the pump body 30 are each implemented in a silicon disc, so that they may for example be joined to each other by silicon fusion bonding. As can be seen from FIG. 1, the membrane element 10 has three recesses in the top side thereof and one recess in the bottom side thereof, to define the three membrane regions 12, 14, and 16.

By the piezo-elements or piezo-ceramics 22, 24, and 26, the membrane sections 12, 14, and 16 may each be actuated in a direction toward the pump body 30, so that the membrane section 12 together with the fluid passage 32 represents an inlet valve 62, which may be closed by actuating the membrane section 12. Likewise, the membrane section 16 and the fluid passage 34 together represent an outlet valve 64, which may be closed by actuating the membrane section 16 by means of the piezo-element 26. Finally, by actuating the piezo-element 24, the volume of the pumping chamber region 42 arranged between the valves can be reduced.

Before going into the functioning of the peristaltic micropump shown in FIG. 1, at first the fluid system environment, in which the micropump according to FIG. 1 is assembled, is to be described. The pump is glued with the pump body 30 on a supporting block 50, wherein optionally, as shown in FIG. 1, splines 52 may be provided in the supporting block 50 to accommodate excess glue. These splines 52 may for example be provided surrounding fluid channels 54 and 56 formed in the supporting block 50, to accommodate excess glue and to prevent it from reaching the fluid channels 54, 56 or the fluid passages 32, 34. The pump body 30 is glued or joined to the supporting block such that the fluid passage 32 is in fluid connection with the fluid channel 54 and that the fluid passage is in fluid connection with the fluid channel 56. Between the fluid channels 54 and 56 a further channel 58 may be provided in the supporting block 50 as transverse leak protection. At the outer ends of the fluid channels 54, 56, fittings 60 are provided, which may for example serve for attaching tubings to the fluid system shown in FIG. 1. Furthermore, in FIG. 1, a housing 61 is schematically shown which is for example joined to a supporting block 50 using a glue connection, to provide protection for the micropump and complete the piezo-elements in a moisture-tight manner.

For the description of a peristaltic pumping cycle of the pump shown in FIG. 1, it is at first to be started from an initial state, wherein the inlet valve 62 is closed, the pumping membrane corresponding to the second membrane section 14 is in the non-actuated state, and the outlet valve 64 is open. Starting from this state, by actuating the piezo-element 24, the pumping membrane 14 is moved downward, which corresponds to the delivery stroke, whereby the stroke volume is conveyed through the open outlet valve into the outlet, i.e. the fluid channel 56. The compressing of the pumping chamber 42 during the delivery stroke by the stroke volume leads to a positive pressure in the pumping chamber, which degrades by the fluid movement through the outlet valve.

Starting from this state, the outlet valve 64 is closed and the inlet valve 62 is opened. Then the pumping membrane 14 is moved upward by ending the actuation of the piezo-element 24. The pumping chamber, which thereby expands, leads to a negative pressure in the pumping chamber, which again results in sucking in fluid through the open inlet valve 62. Then the inlet valve 62 is closed and the outlet valve 64 opened so that the above-mentioned initial state is again achieved. By the described pumping cycle, a fluid volume substantially corresponding to the stroke volume of the membrane section 14 would thus be pumped from the fluid channel 54 to the fluid channel 56.

According to the invention, preferably piezo-membrane converters or piezo-bending converters are used as piezo-actors. Such a bending converter makes an optimum stroke when the lateral dimensions of the piezo-ceramic correspond to about 80% of the underlying membrane. According to lateral dimensions of the membrane, which may typically comprise side lengths of 4 mm to 12 mm, deflections of several 10 μm stroke and thus volume strokes ranging from 0.1 μl to 10 μl may be achieved. Preferred embodiments of the present invention comprise volume strokes at least in such a range, since, in such a volume stroke, bubble-tolerant peristaltic pumps may advantageously be realized.

Figure 2A:
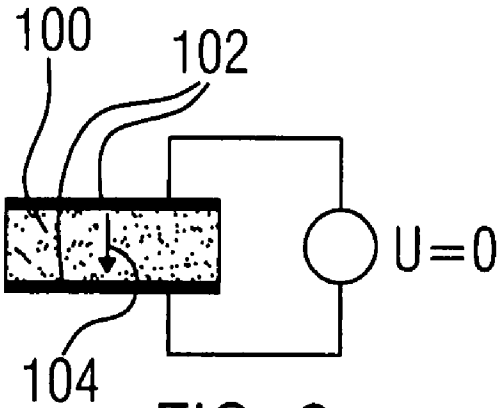
FIGS. 2*a* to 2*f* are schematic illustrations for the explanation of a piezo-membrane converter.

With piezo-membrane converters it is to be noted that these only enable an effective stroke downward, i.e. toward the pump body. In this respect, it is referred to the schematic illustration of FIGS. 2*a* to 2*f*. FIG. 2*a* shows a piezo-ceramic 100 provided with metallizations 102 on both surfaces thereof. The piezo-ceramic preferably includes a large d31 coefficient and is polarized in direction of the arrow 104 in FIG. 2*a*. According to FIG. 2*a*, no voltage is present at the piezo-ceramic.

Figure 2B:
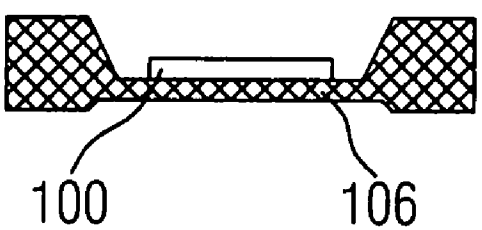

For the production of a piezo-membrane converter, the piezo-ceramic 100 shown in FIG. 2*a* is fixedly mounted on a membrane 106, for example glued, as shown in FIG. 2*b*. The illustrated membrane is a silicon membrane, wherein the membrane, however, may be formed by any other materials, as long as it can be electrically contacted, for example as metallized silicon membrane, as metal foil, or as plastic membrane made conductive by two-component injection molding.

Figure 2C:
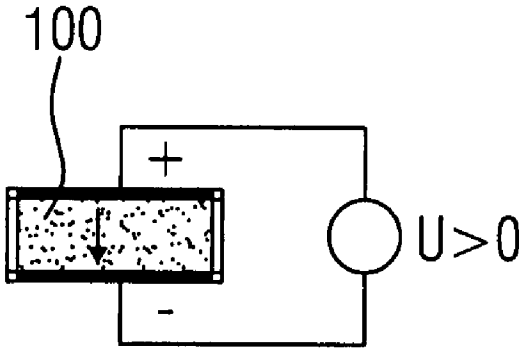
Figure 2D:
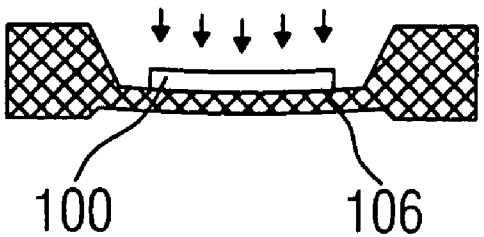

If a positive voltage, i.e. a voltage in polarization direction, U>0 is applied to the piezo-ceramic, the piezo-ceramic contracts, see FIG. 2*c*. By the fixed connection of the piezo-ceramic 100 to the membrane 106, the membrane 106 is deflected downward by this contraction, as is made clear by arrows in FIG. 2*d*.

Figure 2E:
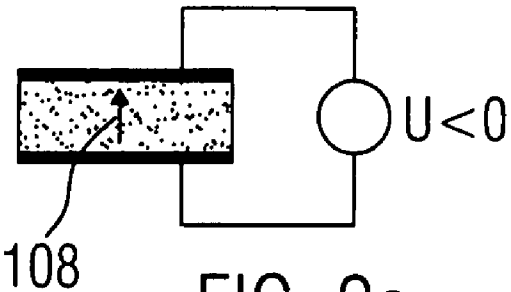
Figure 2F:
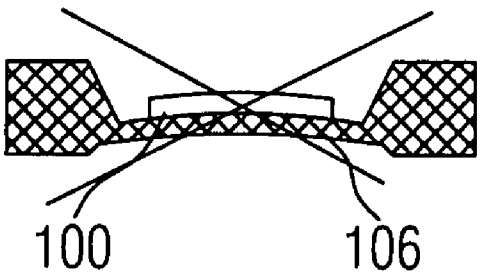

In order to cause an upward movement of the membrane, a negative voltage, i.e. a voltage opposing the polarization direction, would have to be applied to the piezo-ceramic, as shown in FIG. 2*e*. However, this leads to a depolarization of the piezo-ceramic already at low field strength in opposite direction, as suggested in FIG. 2*e* by an arrow 108. Typical depolarization field strengths of PZT ceramics (PZT=plumb zirconate titanate) are for example at −4000 V/cm. Thus, an upward movement of the membrane, i.e. in direction of the piezo-ceramic, cannot be realized, as suggested in FIG. 2*f*.

Despite this disadvantage in that, due to the unsymmetrical nature of the piezo-effect with the two-layer silicon piezo-bending converter, i.e. the piezo-membrane converter, only an active downward movement, i.e. in direction toward the pump body, can be realized, the use of such a bending converter represents a preferred embodiment of the present invention, because this form of converter has numerous advantages. For one part, they have a quick response performance in the order of about 1 millisecond at low energy consumption. Furthermore, scaling with dimensions of piezo-ceramic and membrane is possible across large ranges, so that a large stroke (10 . . . 200 μm) and a large force (switching pressures $10^4$ Pa to $10^6$ Pa) are possible, wherein at a larger stroke the achievable force decreases, and vice versa. Furthermore, the medium to be switched is separated from the piezo-ceramic by the membrane.

If the inventive peristaltic micropumps are to be employed in applications in which a bubble-tolerant, self-priming performance is required, the microperistaltic pumps must be designed to satisfy a design rule regarding the compression ratio defining the ratio of stroke volume to dead volume. For the definition of the terms stroke volume ΔV and dead volume $V_0$, reference is at first made to FIGS. 3*a* to 3*b*.

Figure 3A:
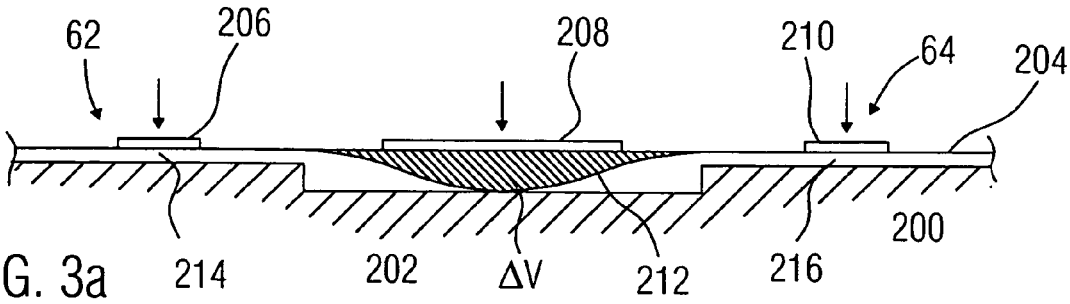
FIGS. 3*a* to 3*c* are schematic cross-sectional illustrations for the explanation of the terms stroke volume and dead volume.

FIG. 3*a* schematically shows a pump body 200 with a top surface thereof, in which a pumping chamber 202 is structured. Above the pump body 200 a membrane 204 is schematically shown, which is provided with an inlet valve piezo-actor 206, a pumping chamber piezo-actor 208 and an outlet valve piezo-actor 210. By the piezo-actors 206, 208, and 210, respective regions of the membrane 204 may be moved downward, i.e. in direction toward the pump body 200, as shown by arrows in FIG. 3*a*. By the line 212, in FIG. 3*a*, the section of the membrane 204 opposing the pumping chamber 200, i.e. the pumping membrane, is also shown in its deflected state, i.e. actuated by the pumping chamber piezo-actor 208. The difference of pumping chamber volume between the non-deflected state of the membrane 204 and the deflected state 212 of the membrane 204 represents the stroke volume ΔV of the pumping membrane.

Figure 3B:
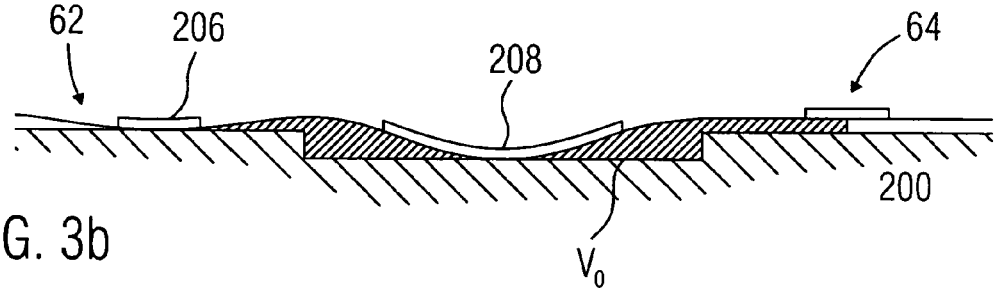
Figure 3C:
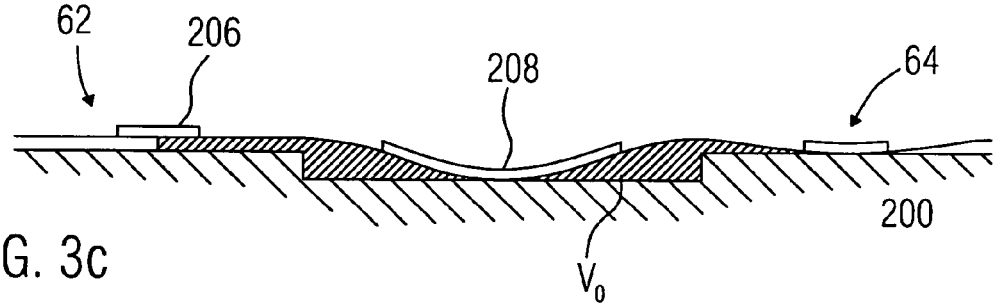

According to FIG. 3*a*, the channel regions 214 and 216 arranged below the inlet valve piezo-actor 206 and below the outlet valve piezo-actor 210 may be closed by respectively actuating the corresponding piezo-actor by the respective membrane region resting on the underlying regions of the pump body. FIGS. 3*a* to 3*c* are only rough schematic illustrations, wherein the respective elements are designed so that closing respective valve openings is possible. Thus, an inlet valve 62 and an outlet valve 64 are again formed.

In FIG. 3*b* a situation is shown in which the volume of the pumping chamber 202 is reduced by actuating the pumping chamber piezo-actor 208, and in which the inlet valve 62 is closed. The situation shown in FIG. 3*b* thus represents the state after the expelling of a fluid quantity from the outlet valve 64, where the volume of the fluid region remaining between the closed inlet valve 62 and the passage opening of the open outlet valve 64 represents the dead volume $V_0$ with reference to the delivery stroke, as shown by the hatched region in FIG. 3*b*. The dead volume with reference to a suction stroke, in which the inlet valve 62 is open and the outlet valve 64 is closed, is defined by the volume of the fluid region remaining between the closed outlet valve 64 and the passage opening of the open inlet valve 62, as shown in FIG. 3*c* by the hatched region.

At this point it is to be noted that the respective dead volume is defined from the respective closed valve to the passage opening, at which in the moment of a respective volume change in the pumping chamber a substantial pressure drop takes place. With a symmetrical construction of inlet and outlet valves, as is preferred for a bi-directional pump, the dead volumes $V_0$ for the delivery stroke and the suction stroke are identical. If different dead volumes result due to an asymmetry for a delivery stroke and a suction stroke, in the following it is to be started, in terms of a worst-case consideration, from the fact that the larger one of both dead volumes is used for ascertaining the respective compression ratio.

The compression ratio of the microperistaltic pump is calculated from the stroke volume ΔV and the dead volume $v_0$ as follows:

$$\epsilon=\Delta V/V_0. \qquad \text{Eq. 1}$$

Figure 4:
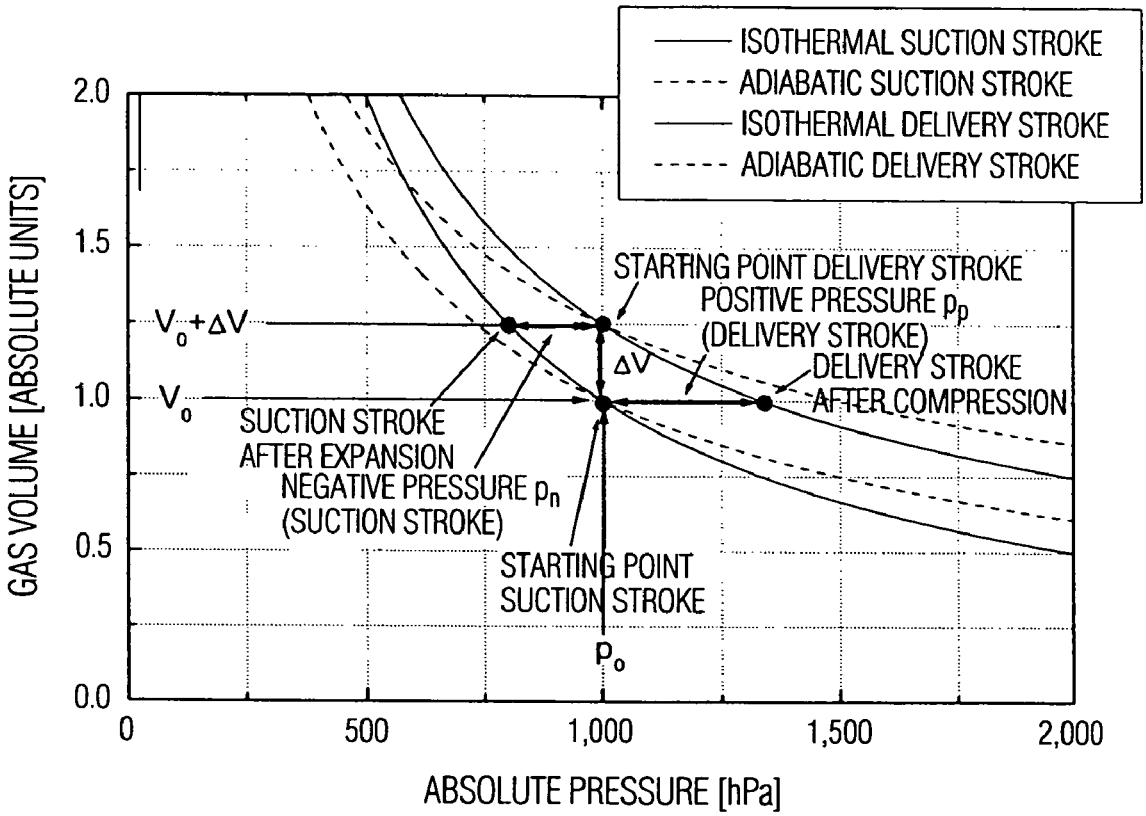
FIG. 4 is a schematic diagram showing the volume/pressure states during a pumping cycle.

In the following it will be started from a worst-case consideration, in which the entire pump region is filled with a compressible fluid (gas). The volume/pressure states occurring in a peristaltic pumping cycle, as it has been described above, in the peristaltic pump are shown in the diagram of FIG. 4. In FIG. 4 both the isothermal volume/pressure curves and the adiabatic volume/pressure curves are shown, wherein, in terms of a worst-case consideration, in the following it is started from isothermal conditions, as they occur in slow changes of state.

At the beginning of a delivery stroke, there is a pressure $p_0$ in the fluid region existing between inlet valve and outlet valve, while this region has a volume $V_0+\Delta V$. Starting from this state, the pressure membrane moves downward during the delivery stroke by the stroke volume ΔV, whereby a positive pressure $p_p$ forms in the fluid region, i.e. the pumping chamber, so that there is a pressure of $p_0+p_p$ at a volume of $V_0$. The positive pressure in the pumping chamber degrades by the air volume ΔV being conveyed through the outlet until pressure compensation has taken place. This streaming out of fluid from the outlet corresponds to a jump from the upper curve to the lower curve in FIG. 4. At the end of the pressure compensation, there is thus a state $p_0$, $V_0$, corresponding to the starting point of a suction stroke. Starting from this state, the membrane is moved away from the pump body, i.e. the volume of the pressure chamber expands by the stroke volume ΔV. Thus, it is changed to the state $p_0-p_n$, $V_0+\Delta V$ designated as "suction stroke after expansion" in FIG. 4. Due to the existing negative pressure, a fluid volume ΔV is sucked through the inlet opening until pressure compensation has taken place. The streaming in of fluid into the pumping chamber corresponds to a jump from the lower curve to the upper curve in FIG. 4. After the pressure compensation, thus there is the state $p_0$, $V_0+\Delta V$, which again corresponds to the starting point of a delivery stroke.

In the above general state considerations serving for the general explanation of the invention, the volume displacements of the inlet valve and outlet valve between the respective suction strokes and delivery strokes have been neglected.

In order to be able to achieve bubble tolerance, the positive pressure $p_p$ at the delivery stroke and the negative pressure $p_n$ at the suction stroke have to exceed a minimum value at the delivery stroke and fall short of it at the suction stroke, respectively. In other words, the pressure magnitude at the delivery stroke and at the suction stroke have to exceed a minimum value, which can be designated as delivery pressure $p_F$. This delivery pressure is the pressure in the pressure chamber that has at least to exist to move a liquid/gas interface past a place representing a flow constriction between the pumping chamber and the passage opening of the first or second valve, including this passage opening. This delivery pressure may be ascertained depending on the size of this flow constriction as follows.

Capillary forces have to be overcome when free surfaces, such as in form of gas bubbles (for example air bubbles) are moved in the fluid regions within the pump. The pressure that has to be applied to overcome such capillary forces depends on the surface tension of the liquid at the liquid/gas interface and the maximum radius of curvature $r_1$ and the minimum radius of curvature $r_2$ of the meniscus of this interface:

$$\Delta p = \sigma\left(\frac{1}{r_1}+\frac{1}{r_2}\right) \qquad \text{Eq. 2}$$

The delivery pressure to be produced is defined by equation 2, namely at the place of the flow path of the microperistaltic pump at which the sum of the inverse radii of curvature $r_1$ and $r_2$ of a liquid/gas interface at a given surface tension is maximal. This place corresponds to the flow constriction.

Figures 5A, 5B, 5C:
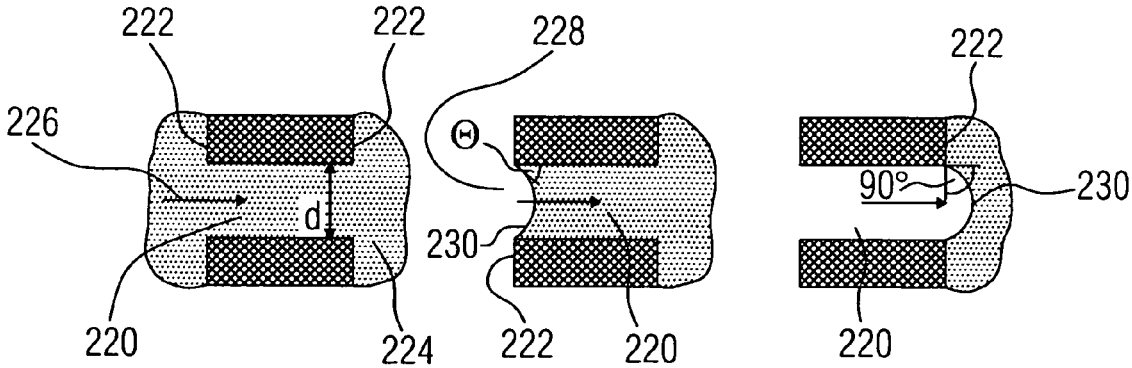
FIGS. 5*a* to 5*c* are schematic illustrations for the explanation of the term delivery pressure.

For illustration, for example a channel 220 (FIG. 5*a*) with a width d is to be considered, the height of the channel also being d. The channel 220 has a cross-sectional change at both channel ends 222, such as below the valve membrane or the pumping membrane. In FIG. 5*a*, the channel is completely filled with a liquid 224 flowing in direction of the arrow 226.

According to FIG. 5*b*, an air bubble 228 now impinges on the cross-sectional change at the input of the channel 220. Here, a wetting angle θ occurs. The wetting angle θ defines a maximum radius of curvature $r_1$ and a minimum radius of curvature $r_2$ of a meniscus 230 to be moved through the channel 220, wherein $r_1=r_2$ at equal height and width of the channel. In FIG. 5*c*, the situation is illustrated, when the air bubble, or the meniscus 230, reaches the cross-sectional change 222 at the end of the channel 220.

If such a channel represents the region of a fluid system at which the greatest capillary force has to be overcome, the required pressure in this special case with $r_1=r_2=r=d/2$, is:

$$\Delta p = \sigma\frac{2}{r} = \sigma\frac{4}{d} \qquad \text{Eq. 3}$$

In microperistaltic pumps of the inventive kind, this pressure barrier is not to be neglected due to the small geometry dimensions, when such -a channel represents the constriction of the pump. With a line diameter of for example d=50 μm and a surface tension air/water of $\sigma_{wa}$=0.075 N/m, the pressure barrier is $\Delta p_b$=60 hPa, wherein with a channel diameter d=25 μm the pressure barrier is $\Delta p_b$=120 hPa.

With microperistaltic pumps of the inventive kind, the constriction mentioned, however, will usually be defined by the distance between valve membrane and opposing region of the pump body (for example a sealing lip) at opened valve. This constriction represents a slit having infinite width as opposed to the height, i.e. $r_1$=r and $r_2$=infinite.

From the above equation 2, for such a channel the following results:

$$\Delta p = \sigma \frac{1}{r} \quad \text{Eq. 4}$$

In general, the connection between the smallest radius of curvature and the smallest wall distance d is given by the following relationship:

$$r = \frac{d}{2 \cdot \sin(90° + \Gamma - \Theta)} \quad \text{Eq. 5}$$

wherein Θ represents the wetting angle and Γ the tilt between the two walls.

The worst case, i.e. the smallest radius of curvature independent of tilt angle and wetting angle, is given when the sine function becomes maximal, i.e. sin(90°+Γ−Θ)=1. This occurs for example at abrupt cross-sectional changes, as they are shown in FIG. 5*a* to 5*c* or at combinations of tilt angle Γ and wetting angle Θ. In the worst case the following applies:

$$r = \frac{d}{2} \quad \text{Eq. 6}$$

The half of the smallest occurring wall distance may thus be considered the smallest occurring radius of curvature, independent of the tilt angle Γ, wetting angle Θ or abrupt cross-sectional changes.

On the one hand, in a peristaltic pump, fluid connections exist between the chambers with a given channel geometry and a constriction defining the lowest passage dimension d. For such a channel the following applies:

$$\Delta p = \sigma \frac{4}{d} \quad \text{Eq. 7}$$

On the other hand, the peristaltic pump has a constriction at the inlet or outlet valve, which is defined by the slit geometry dependent on the valve stroke. For this the following applies:

$$\Delta p = \sigma \frac{2}{d} \quad \text{Eq. 8}$$

The respective constriction (channel constriction or valve constriction in the open state) at which greater capillary forces have to be overcome may be regarded as flow constriction of the microperistaltic pump.

In preferred embodiments of the present invention, connection channels within the peristaltic pump are thus designed such that the diameter of the channel exceeds at least double the valve constriction, i.e. the distance between membrane and pump body in the opened valve state. In such a case, the valve slit represents the flow constriction of the microperistaltic pump. For example, with a valve stroke of 20 μm, connections channels with a smallest dimension, i.e. constriction, of 50 μm may be provided. The upper limit of the channel diameter is determined by the dead volume of the channel.

The capillary force to be overcome depends on the surface tension at the liquid/gas interface. This surface tension again depends on the partners involved. For a water/air interface, the surface tension is about 0.075 N/m and slightly varies with the temperature. organic solvents usually have a significantly lower surface tension, whereas the surface tension at a mercury/air interface is for example about 0.475 N/m. A peristaltic pump designed to overcome the capillary force at a surface tension of 0.1 N/m is thus suited to pump almost all known liquids and gasses in a bubble-tolerant and self-priming manner. Alternatively, the compression ratio of an inventive microperistaltic pump may be made correspondingly higher to enable such pumping for example also for mercury.

The design rules discussed subsequently hold for the conveyance of gases and incompressible liquids, wherein, in the conveyance of liquids, it has to be started from the fact that in the worst case air bubbles fill the entire pumping chamber volume. In the conveyance of gases it has to be reckoned with the fact that, due to condensation, liquid may reach the pump. In the following it is started from the fact that the piezo-actor is designed so that all required negative pressures and positive pressures may be achieved.

At first, a delivery stroke is to be considered. During the expulsion process, the actor membrane compresses the gas volume, or air volume. The maximum positive pressure in the pumping chamber $p_p$ is then determined by the pressure in the air bubble. It is calculated from the state equation of the air bubble.

$$p_0(V_0+\Delta V)^{\gamma A}=(p_0+p_p)(V_0)^{\gamma A} \quad \text{Eq. 9}$$

The variables $p_0$, $V_0$, ΔV and $p_p$ have been explained above with reference to FIG. 4. $\gamma_A$ represents the adiabatic coefficient of the gas, i.e. air. The left side of the above equation represents the state before the compression, whereas the right side represents the state after the compression. Furthermore, the positive pressure $p_p$ at the delivery stroke has to be greater than the positive delivery pressure $p_F$:

$$p_P > p_F \quad \text{Eq. 10}$$

Now, a suction stroke is to be considered. The suction stroke differs by the starting location of the volumes. After the expansion the negative pressure $p_n$ develops in the pumping chamber, i.e. $p_n$ is negative:

$$p_0 V_0^{\gamma A}=(p_0+p_n)(V_0+\Delta V)^{\gamma A} \quad \text{Eq. 11}$$

The left side of equation 11 reflects the state before the expansion, whereas the right side reflects the state after the expansion. The negative pressure $p_n$ at the delivery stroke has to be smaller than the required negative delivery pressure $p_F$. It is to be noted that the delivery pressure $p_F$ is positive in magnitude considering the delivery stroke, negative in magnitude considering the suction stroke. It follows:

$$P_n < p_F \quad \text{Eq. 12}$$

From the above equations the following results for the minimum compression ratio necessary of bubble-tolerant microperistaltic pumps for the delivery stroke:

$$\varepsilon < \left(\frac{p_0}{p_0 + p_F}\right)^{\frac{1}{\gamma_A}} - 1 \quad \text{Eq. 13}$$

The following compression ratio results for the suction stroke:

$$\varepsilon < \left(\frac{p_0}{p_0 + p_F}\right)^{\frac{1}{\gamma_A}} - 1 \quad \text{Eq. 14}$$

If the delivery pressure $p_F$ is small as opposed to the atmospheric pressure $p_0$, the previous equations may be simplified as follows, which corresponds to a linearization about the point $p_0$, $V_0$:

$$\text{Delivery stroke: } \varepsilon > -\frac{1}{\gamma_A}\frac{p_F}{p_0} \quad \text{Eq. 15}$$

$$\text{Suction stroke: } \varepsilon > -\frac{1}{\gamma_A}\frac{p_F}{p_0} \quad \text{Eq. 16}$$

The following results as valid equation for the suction stroke and the delivery stroke.

$$\varepsilon > -\frac{1}{\gamma_A}\frac{|p_F|}{p_0} \quad \text{Eq. 17}$$

With quick changes of state, the conditions are adiabatic, i.e. $\gamma_A$=1.4 for air. With slow changes of state, the conditions are isothermal, i.e. $\gamma_A$=1. With a consequent application of the worst-case assumption, a criterion with $\gamma_A$=1 is used in the following. Thus, as design rule for the necessary compression ratio of bubble-tolerant microperistaltic pumps, it may be stated that the compression ratio has to be greater than the ratio of the delivery pressure to the atmospheric pressure, i.e.:

$$\varepsilon > \frac{|p_F|}{p_0} \quad \text{Eq. 18}$$

Or with the volumes mentioned:

$$\frac{\Delta V}{V_0} > \frac{|p_F|}{p_0} \quad \text{Eq. 19}$$

The above-indicated simple linear design rule corresponds to the tangent on the isothermal state equation of FIG. 4 in the point $p_0$, $V_0$.

Preferred embodiments of inventive microperistaltic pumps are thus designed such that the compression ratio satisfies the above condition, wherein the minimum necessary delivery pressure corresponds to the pressure defined in equation 8 when channel constrictions occurring in the peristaltic pump have minimum dimensions at least double the size of the valve slit. Alternatively, the minimum required delivery pressure may correspond to the pressure defined in equation 3 or equation 7, when the flow constriction of the microperistaltic pump is not defined by a slit but a channel.

If an inventive microperistaltic pump is to be employed when pressure boundary conditions of a negative pressure pi at the inlet or a back pressure $p_2$ at the outlet exist, the compression ratio of a microperistaltic pump has to be correspondingly greater to enable pumping against these inlet pressures or outlet pressures. The pressure boundary conditions are defined by the provided application of the microperistaltic pump and may range between few hPa to several 1000 hPa. For such cases, the positive pressure $p_p$ or negative pressure $p_n$ occurring in the pumping chamber has to at least achieve these back pressures so that a pumping action occurs. For example, the height difference of a possible inlet vessel or outlet vessel of 50 cm alone leads to back pressures of 50 hPa with water.

Furthermore, the desired conveyance rate represents a boundary condition posing additional requirements. With a given stroke volume ΔV, the conveyance rate Q is defined by the operational frequency f of the repeating peristaltic cycle: Q=ΔV·f. Within the period duration T=1/f, both the suction stroke and the delivery stroke of the peristaltic pump have to be performed, in particular the stroke volume ΔV has to be shifted. The time available thus is a maximum of T/2 for suction stroke and delivery stroke. The required time to convey the stroke volume through the pumping chamber feed line and the valve constriction depends on the one hand on the flow resistance, on the other on the pressure amplitude in the pumping chamber.

If foam-like substances are to be pumped with an inventive microperistaltic pump, it may be necessary to overcome a plurality of capillary forces, as they are described above, since several corresponding liquid/gas interfaces occur. In such a case, the microperistaltic pump has to be designed to have a compression ratio to be able to produce correspondingly higher delivery pressures.

In summary, it may be stated that the compression ratio of an inventive microperistaltic pump has to be chosen correspondingly higher, when the delivery pressure $p_F$ necessary in the microperistaltic pump, apart from the mentioned capillary forces, is further dependent on the boundary conditions of the application. It should be noted that here the delivery pressure relative to the atmospheric pressure is considered, a positive delivery pressure $p_F$ being assumed in the delivery stroke, wherein a negative delivery pressure $p_F$ is assumed in the suction stroke. As a technically sensible value for robust operation, thus a magnitude of the delivery pressure of at least $p_F$=100 hPa may be assumed for a suction stroke and a delivery stroke.

Considering a back pressure of for example 3000 hPa at the pump outlet, against which it has to be pumped, a compression ratio of ε>3 results according to the above equation 13, wherein an atmospheric pressure of 1013 hPa is assumed.

If the microperistaltic pump has to suck against a great negative pressure, for example a negative pressure of −900 hPa, according to the above equation 14, a compression ratio of ε>9 is to be met to enable pumping against such a negative pressure.

Examples of peristaltic micropumps enabling the realization of such compression ratios are subsequently explained in greater detail.

Figure 6A:
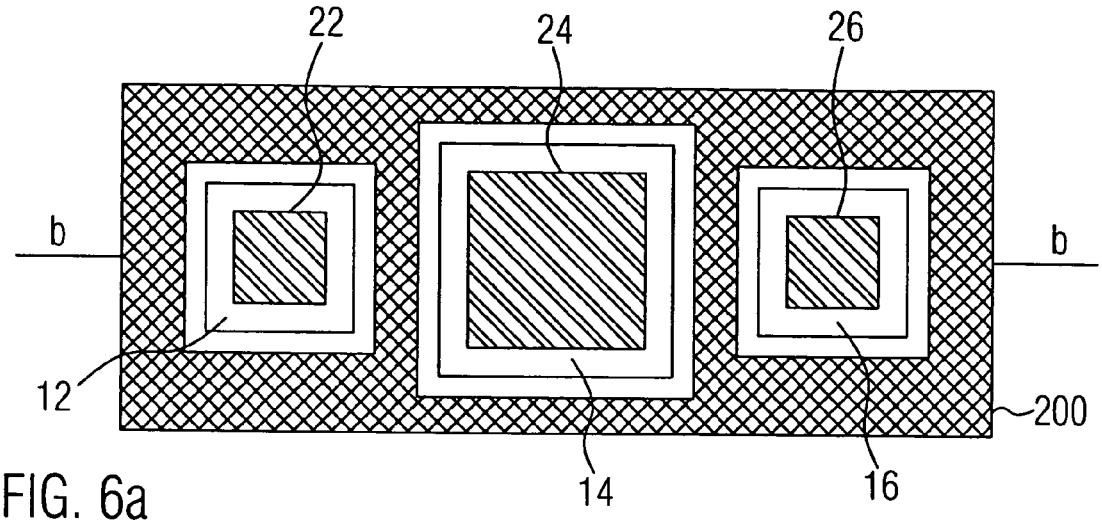
FIGS. 6*a* to 6*c* are schematic views of an alternative embodiment of an inventive micropump.
Figure 6B:
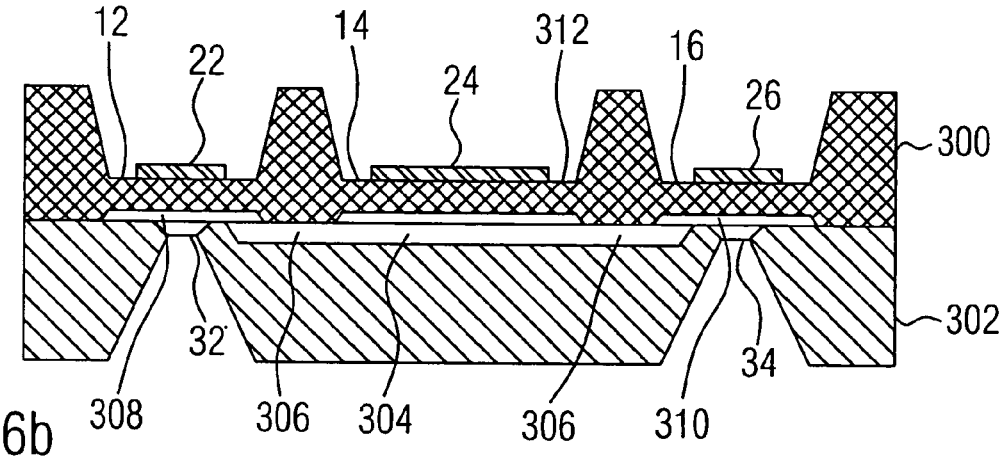
Figure 6C:
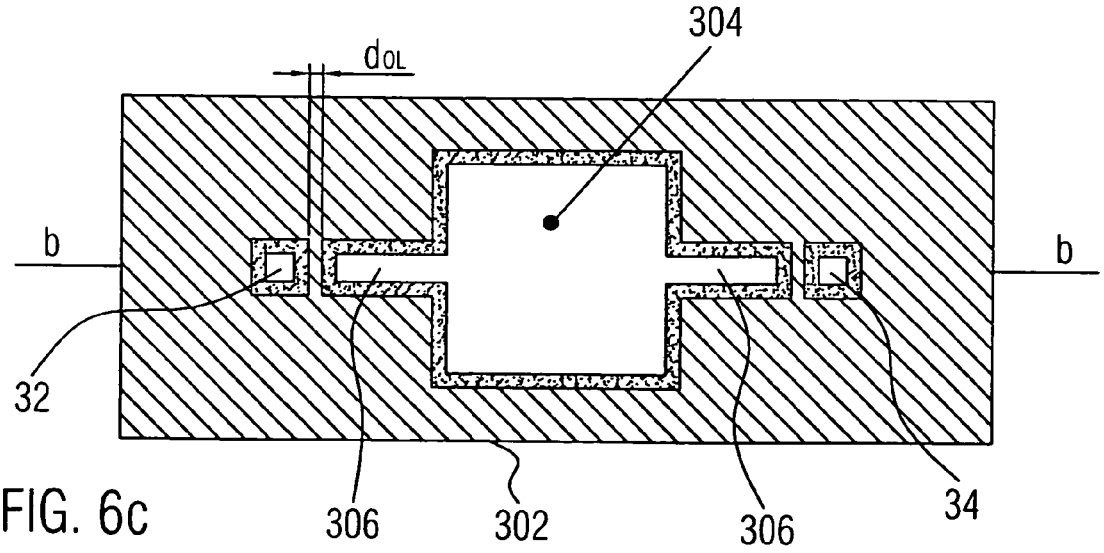

FIG. 6*b* shows a schematic cross-sectional view of a peristaltic micropump with membrane element 300 and pump body 302 along the line b—b of FIG. 6*a* and FIG. 6*c*, whereas FIG. 6*a* shows a schematic top view on the membrane element 300 and FIG. 6*c* a schematic top view on the pump body 302. The membrane element 300 in turn has three membrane sections 12, 14, and 16 each provided with piezo-actors 22, 24, and 26. In the pump body 302, an inlet opening 32 and an outlet opening 34 are again formed such that the inlet opening 32, together with the membrane region 12, defines an inlet valve, whereas the outlet opening 34 defines an outlet valve with the membrane region 16. Below the membrane section 14, a pumping chamber 304 is formed in the pump body 302. Furthermore, fluid channels 306 are formed in the pump body 302, which are fluidically connected to the valve chambers 308 and 310 associated with the membrane regions 12 and 16. The valve chambers 308 and 310 are formed by recesses in the membrane element 300 in the embodiment shown, wherein, in the membrane element 300, a recess 312 contributing to the pumping chamber 304 is also formed.

In the embodiment shown in FIGS. 6*a* to 6*c*, the pumping chamber volume 304 is embodied greater than the volumes of the valve chambers 308 and 310. In the embodiment shown, this is achieved by a structure in the form of a pumping chamber depression being formed in the pump body 302. The stroke of the pumping membrane 14 is preferably designed so that it can largely displace the volume of the pumping chamber 304.

Further increase of the pumping chamber volume as opposed to the valve chamber volume is achieved in the embodiment shown in FIGS. 6*a* to 6*c* by the pumping chamber membrane 14 being designed greater in area (in the plane of the membrane element 300 or the pump body 302) than the valve chamber membranes, as can best be seen in FIG. 6*a*. Thus, a pumping chamber greater in area compared to the valve chambers results.

In order to reduce the flow resistance between the valve chambers 308 and 310 and the pumping chamber 304, the feeding channels 306 are structured in the surface of the pump body 302. These fluid channels 306 provide a reduced flow resistance without significantly degrading the compression ratio of the peristaltic micropump.

Alternatively to the embodiment shown in FIGS. 6*a* to 6*c*, the surface of the pump body 302 could be realized with three-step depressions to implement the pumping chamber of increased depth (compared to the valve chambers), whereas the upper chip is a substantially unstructured membrane. Such two-step depressions are technologically slightly more difficult to realize than the embodiment shown in FIGS. 6*a* to 6*c*.

Exemplary dimensions of the embodiment shown in FIGS. 6*a* to 6*c* of a peristaltic micropump are as follows:

dimension of the valve membranes 12, 16: 7.3×5.6 mm;

dimension of the pumping membrane 14: 7.3×7.3 mm;

membrane thickness: 40 mn;

diameter of the inlet or outlet nozzles 32, 34: at least 50 μm;

valve chamber height: 8 μm;

height of the pumping chamber: 30 μm;

width of the valve sealing lips $d_{DL}$: 10 μm;

realizable overall size: 8×21 mm;

dimensions of the piezo-elements: area: 0.8 times membrane dimension, thickness: 2.5 times membrane thickness;

thickness of the piezo-elements: 100 μm; and opening cross-section of the openings 32, 34: 100 μm×100 μm.

Figure 7:
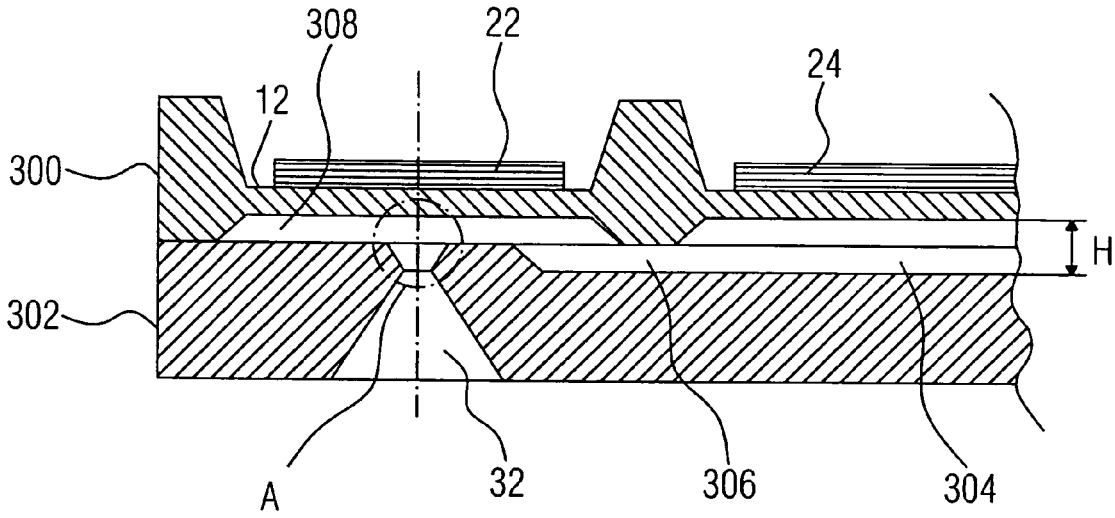
FIG. 7 is an enlarged illustration of a region of FIG. 6*b;*

An enlarged illustration of the left part of the cross-sectional illustration shown in FIG. 6*b* is shown in FIG. 7, wherein in FIG. 7 the height H of the pumping chamber 304 is displayed. Although, according to the illustration of FIG. 7, the structures forming the pumping chamber 304 in the pump body 302 and in the membrane element 300 have equal depths, it is preferred to define the structures in the pump body 302 with a greater depth than in the membrane element to provide the flow channel 306 with sufficient flow cross-section, but without excessively impeding the compression ratio. For example, the structures in the pump body 302 contributing to the fluid channel 306 and the pumping chamber 304 may have a depth of 22 μm, whereas the structures in the membrane element 300 defining the valve chambers 308 or contributing to the pressure chamber 304 may have a depth of 8 μm.

Figure 8:
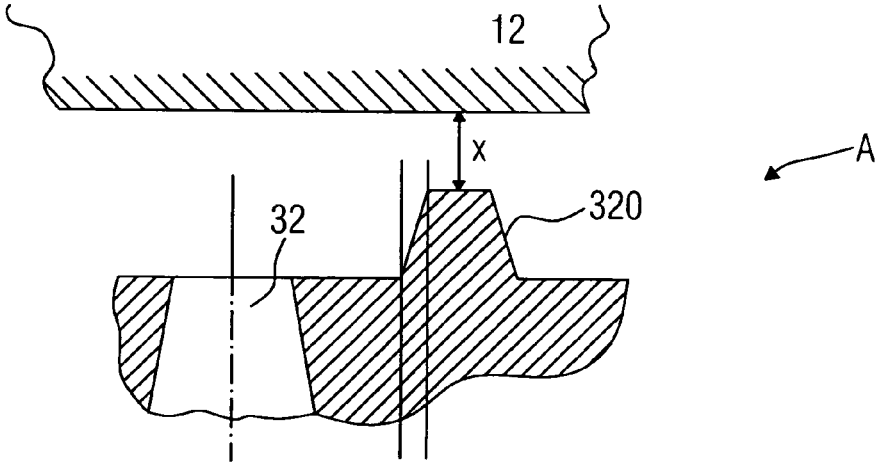
FIG. 8 is an enlarged cross-sectional illustration of a modified region of FIG. 7.

FIG. 8 illustrates a schematic cross-sectional view of an enlargement of the section A of FIG. 7, but in modified form. According to FIG. 8, the ridge is arranged spaced from the opening 32 in direction of the channel 206. Thereby, mounting tolerances may be taken into account in a double-sided lithography. Furthermore, it may be prevented with this that wafer thickness variations, which may result in valve openings with different cross-sectional sizes, have negative effects. As can be recognized in FIG. 8, the distance x to the membrane 12 defines the flow constriction between pumping chamber and valve passage opening in open valve position.

As explained above, in the regions of the fluid system in which a pumping action is required, the compression ratio of a peristaltic pump has to be chosen large by forming a pumping chamber volume of a peristaltic pump, to guarantee self-priming performance and robust operation with reference to bubble tolerance. In order to achieve this, it is preferred to keep the dead volumes small, which may be supported by adapting the contour or shape of the pumping chamber to the bend line of the pumping membrane in the deflected state.

Figure 9A:
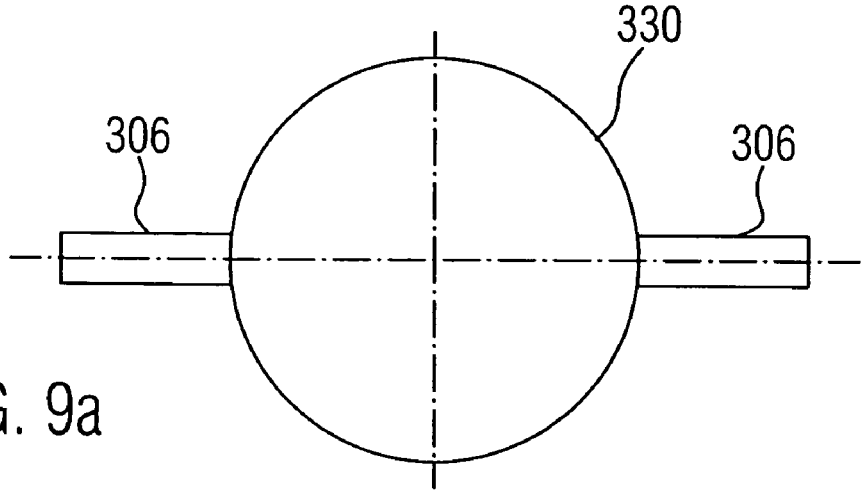
FIGS. 9*a*, 9*b* and 9*c* are schematic illustrations of possible pumping chamber designs.

A first possibility to realize such an adaptation consists in implementing a round pumping chamber, i.e. a pumping chamber whose circumferential shape is adapted to the deflection of the pumping membrane. A schematic top view on the pumping chamber and fluid channel section of a pump body with such a pumping chamber is shown in FIG. 9*a*. Again comparable with the illustration of FIG. 6*c*, the fluid channels 306 making a fluidical connection to valve chambers that may for example again be structured in a membrane element again lead into the round pumping chamber 330.

Figure 9B:
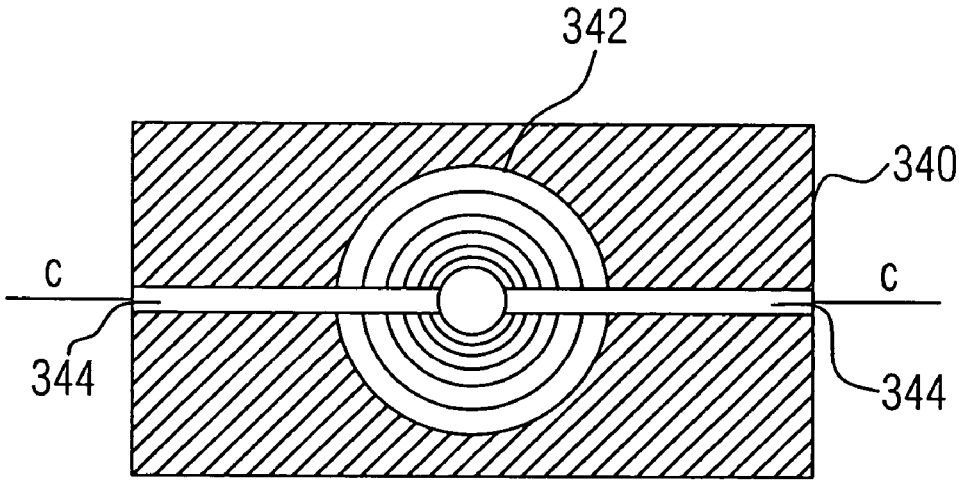
Figure 9C:
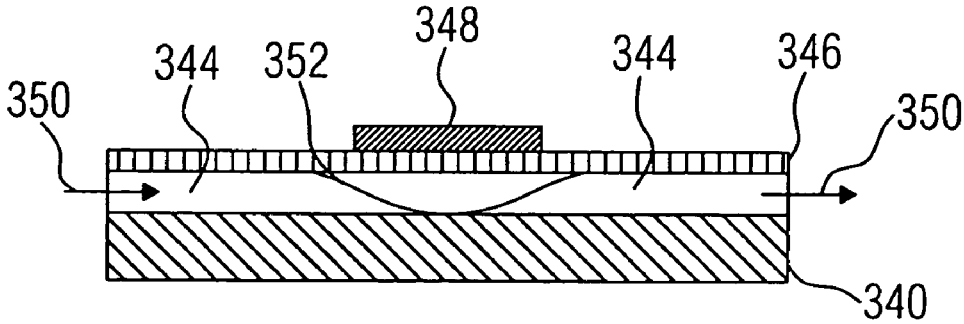

In order to be able to achieve a further reduction of the dead volume, and thus a further increase of the compression ratio, the pumping chamber below the pumping membrane may be designed so that its contour facing the pumping-membrane fittingly follows the bend line of the pumping membrane. Such a contour of the pumping chamber may for example be achieved by a correspondingly formed injection molding tool or by an embossing stamp. A schematic top view on a pump body 340, in which such a fluid chamber 342 following the bend line of the actor membrane is structured, is shown in FIG. 9*b*. Furthermore, in FIG. 9*b*, fluid channels 344 structured in the pump body, which lead to or away from the fluid chamber 342 are illustrated. Such a schematic cross-sectional view along the line c-c of FIG. 9*b* is shown in FIG. 9*c*, wherein in FIG. 9*c* also a membrane 346 with a piezo-actor 348 associated therewith is illustrated. A flow through the fluid channels 344 is indicated by arrows 350 in FIG. 9*c*. Furthermore, in FIG. 9*c*, the contour 352 of the fluid chamber or pumping chamber 342 facing the membrane 346 and adapted to the bend line of the membrane (in the actuated state) can be recognized. This shape of the fluid chamber 352 enables, when actuating the membrane 346 by the piezo-actor 348, substantially the entire volume of the fluid chamber 342 to be displaced, whereby a high compression ratio may be achieved.

Figure 10A:
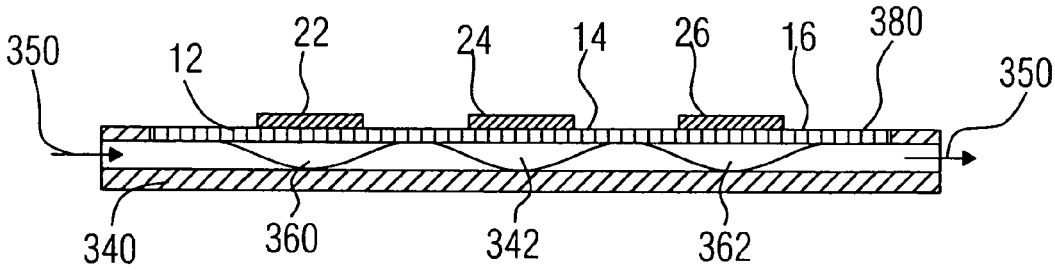
FIGS. 10*a* and 10*b* are schematic illustrations of an alternative embodiment of an inventive micropump.
Figure 10B:
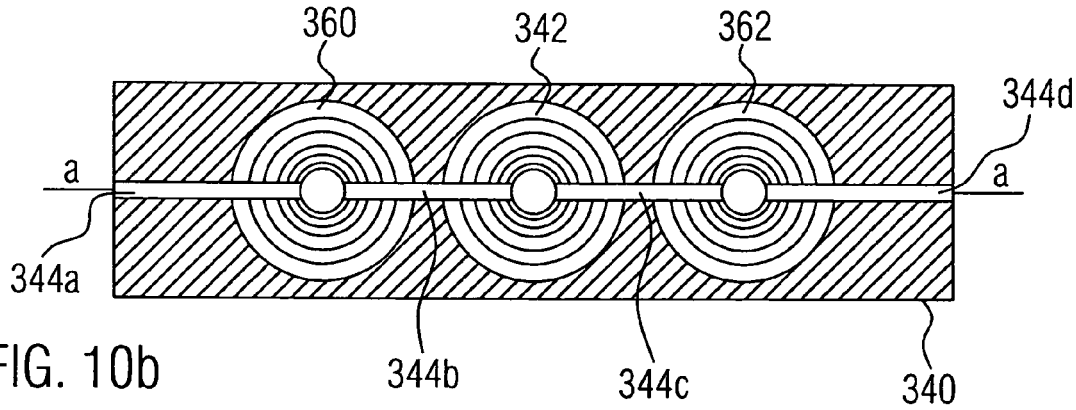

An embodiment of a peristaltic micropump, in which both the pumping chamber 342 and the valve chambers 360 are adapted to the bend lines of the respectively associated membrane sections 12, 14, and 16, is shown in FIGS. 10*a* and 10*b*, wherein FIG. 10*b* shows a schematic top view on the pump body 340, whereas FIG. 10*a* shows a schematic cross-sectional view along the line a—a of FIG. 10*b*. As can be taken from FIGS. 10*a* and 10*b*, shape and contour of the valve chambers 360 and 362 are, as explained above with reference to the pumping chamber 342, adapted to the bend line of the respectively associated membrane section 12 or 16. As can also best be seen in FIG. 10*b*, again fluid channels 344*a*, 344*b*, 344*c*, and 344*d* are formed in the pump body 340. The fluid channel 344*a* represents an input fluid channel, the fluid channel 344*b* connects the valve chamber 360 to the pumping chamber 342, the fluid channel 344*c* connects the pumping chamber 342 to the valve chamber 362, and the fluid channel 344*d* represents an output channel.

As is shown in FIG. 10*a*, the membrane element 380 in this embodiment is an unstructured membrane element inserted into a recess provided in the pump body 340, in order to define, together with the fluid regions formed in the pump body 340, the valve chambers and the pumping chamber.

Figure 11:
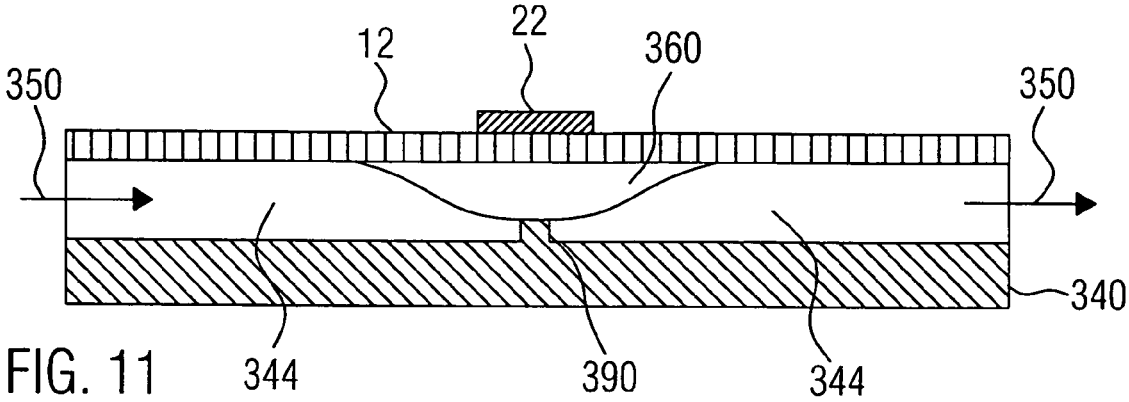
FIGS. 11 to 13 are schematic cross-sectional views of enlarged regions of modifications of the example shown in FIGS. 10*a* and 10*b;*

The connection channels 344*b* and 344*c* between the actor chambers are switched so that they contain a small dead volume in comparison with the stroke volume. At the same time these fluid channels significantly decrease the flow resistance between the actor chambers so that also greater pumping frequencies, and thus greater conveyance flows, wherein such a flow is again indicated by arrows 350 in FIG. 10*a*, become possible. In the region of the valve chambers 360 and 362, the fluid channels are separated by actuating the membrane sections 12 or 16 by the completely deflected membrane sections, so that a fluid separation between the fluid channels 344*a* and 344*b* or between the fluid channels 344*c* and 344*d* occurs. The contour of the valve chambers must be adapted exactly to the bend line of the respective membrane sections to achieve a tight fluid separation. Alternatively, as shown in FIG. 11, a ridge 390 may be provided in the respective valve chamber in the region of the largest stroke of the membrane section 12, which is correspondingly shaped so as to be able to be completely sealed by the bend of the membrane section 12. More specifically, the ridge bends upward toward the edges of the valve chamber, corresponding to the shape of the valve chamber adapted to the bend line. This ridge may project into the respective valve chamber, wherein alternatively, as shown in FIG. 11, the depth of the connections channels 344 may be greater than the stroke y of the membrane section 12, at which the membrane section abuts to the pump body, so that the ridge 390 is sunk, so to speak. If the depth of the connection channels is greater than the maximum stroke, this is at cost of the compression ratio, but enables low flow resistances between the actor chambers.

Figure 12:
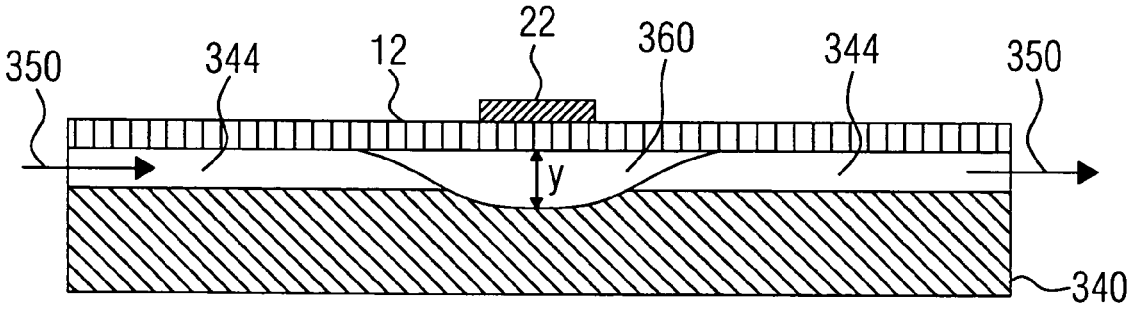

An alternative embodiment of a valve chamber 360 is shown in FIG. 12, wherein there the depth of the connection channels 344 is smaller than the maximum stroke y of the membrane section 12, and thus than the depth of the valve chamber 360 adapted to the bend line of the membrane section 12 in the region of the greatest stroke of the membrane section 12. Thereby, safe sealing may be achieved in the closed state of the valve.

Figure 13:
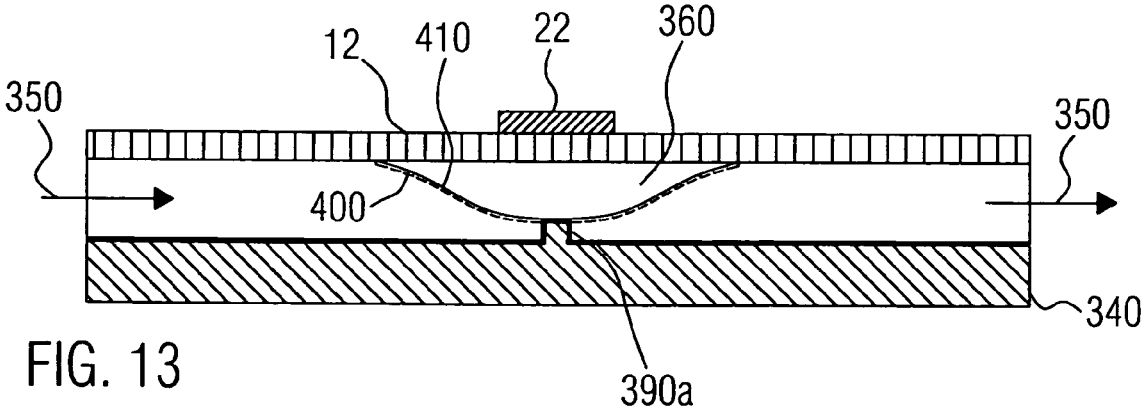

In order to achieve a valve sealing in the closed state, which satisfies default pressure requirements, it may be preferred to provide a ridge 390*a* in the valve chamber 360, which does not replicate the maximum possible bend line of the actor element, i.e. the membrane section 12, together with the piezo-actor 22, as shown in FIG. 13. The maximum possible bend line of the membrane section 12 is shown in FIG. 13 by a dashed line 400, wherein the line 410 corresponds to the maximum possible deflection of the membrane section 12 due to providing the ridge 390*a*. Thus, the membrane 12 sits on the ridge 390*a* with a residual force in the fully deflected state, when the ridge 390 is being sealed, wherein this residual force may be dimensioned to satisfy pressure requirements the seal has to withstand.

In practical realizations, the bend line of the membrane will often not be perfectly concentric to the membrane center, for example due to mounting tolerances of the piezo-ceramics and due to inhomogeneities of the glue application, by which the piezo-ceramics are attached to the membranes. Therefore, the region of the ridge sealing may be slightly, for example by about 5 to 20 μm, increased as opposed to the rest of the fluid chamber, depending on the stroke of the actor, to guarantee secure contact of the membrane with the ridge, and thus secure sealing. This also corresponds to the situation shown in FIG. 13. It is to be observed, however, that thereby the dead volume is increased and the compression ratio is decreased.

Alternatively to the mentioned possibilities, a plastically deformable material, such as silicon, may be used as fluid chamber material at least in the region below the movable membrane. By actor forces, which are designed correspondingly great, inhomogeneities may then be balanced. In such a case, no hard-hard seal is present any more, so that there is a certain tolerance against particles and deposits.

In the following, an exemplary dimensioning of a peristaltic pump, as it is shown in FIGS. 10*a* and 10*b*, is to be indicated briefly. The thickness of the membrane sections 12, 14, and 16, and thus the thickness of the membrane element 380, may for example be 40 μm, whereas the thickness of the piezo-actors may for example be 100 μm. As piezo-ceramic, a PZT ceramic with a large d31 coefficient may be used. The side length of the membranes may for example be 10 mm, whereas the side length of the piezo-actors may for example be 8 mm. The voltage swing for actuating the actors with the actor geometry mentioned may for example be 140 V, which results in a maximum stroke of about 100 to 200 μm with a stroke volume of the pumping membrane of about 2 to 4 μl.

By the adaptation of the fluid chamber design to the bend line of the membrane, the dead volume of the three fluid chambers required for the peristaltic pump ceases to exist, so that only the connection channels connecting the valve chamber to the pumping chamber remain. If connection channels with a depth of 100 μm, a width of 100 μm, and a length of 10 mm each are used, so that an overall length for the fluid channels 344*b* and 344*c* of 20 mm results, this results in a pumping chamber dead volume of 0.2 μl. Therefrom a compression ratio $\epsilon=\Delta V/V=4\ \mu l/0.2\ \mu l=20$ may be ascertained.

With such a great compression ratio of up to 20, such fluid modules are bubble-tolerant and self-priming and can convey both liquids and gases. In principle , such fluid pumps may further build up several bars of pressure for compressible and liquid media, depending on the design of the piezo-actor. With such a micropump, the maximum producible pressure is no longer limited by the compression ratio, but defined by the maximum force of the drive element and by the tightness of the valves. In spite of these properties, several ml/min may be conveyed by suitable channel dimensioning with a low flow resistance.

In the above-described embodiment, all fluid channels, i.e. also the inlet fluid channel 344*a* and the outlet fluid channel 344*d*, are guided laterally, i.e. the fluid channels pass in the same plane as the fluid chambers. As set forth above, in such a course, the sealing of the channels may be difficult. It is, however, advantageous in the lateral course of the fluid channels that the entire fluid system, including reservoirs connected to the inlet channel 344*a* and/or the outlet channel 344*d*, may be shaped with one production step, such as with injection molding or embossing.

Figure 14:
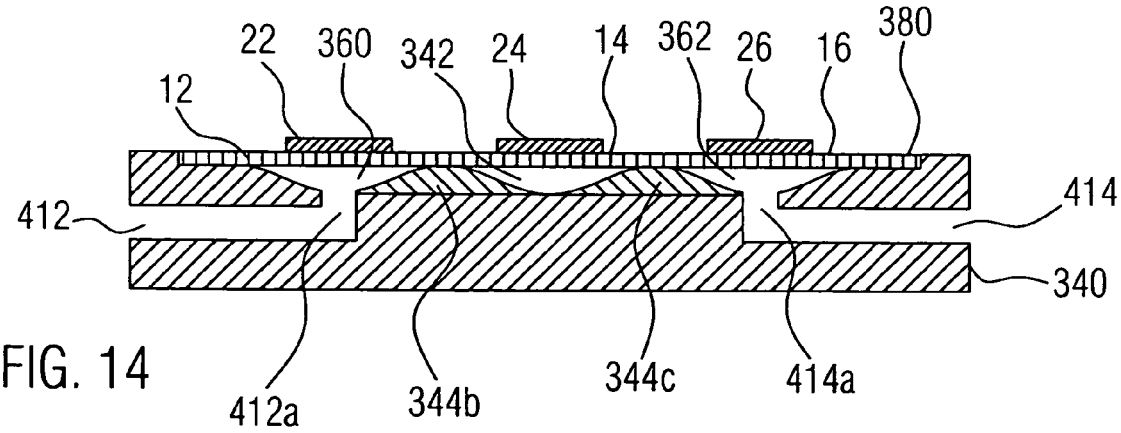
FIG. 14 is a schematic cross-sectional view of a further alternative embodiment of an inventive micropump.

In FIG. 14, an embodiment of an inventive microperistaltic pump is shown, in which the inlet fluid channel 412 and the outlet fluid channel 414 are vertically sunk in the pump body 340. The fluid channels 412 and 414 have a substantially vertical section 412*a* and 414*a*, each leading substantially centrally below the associated membrane sections 12 or 16 into the valve chambers 360 or 362. The advantage of the embodiment of the fluid channels shown in FIG. 14 is that the fluid channels may be sealed in a defined manner. It is, however, disadvantageous that such vertically sunk fluid channels are difficult to produce in terms of fabrication.

The inventive peristaltic micropumps are preferably controlled by the membrane, for example the metal membrane or the semiconductor membrane, lying on a ground potential, whereas the piezo-ceramics are moved by a typical peristaltic cycle, by corresponding voltages each being applied to the piezo-ceramics.

Apart from the above-described microperistaltic pump using three fluid chambers 342, 360, and 362, an inventive peristaltic micropump may comprise further fluid chambers, for example a further fluid chamber 420 connected to the pumping chamber 342 via a fluid channel 422. Such a structure is schematically shown in FIG. 15, wherein a first reservoir 424 is connected to the valve chamber 360 via the fluid channel 344*a*, a second reservoir 426 is connected to the valve chamber 420 via a fluid channel 428, and a third reservoir 430 is connected to the valve chamber 362 via the fluid channel 344*d*.

Figure 15:
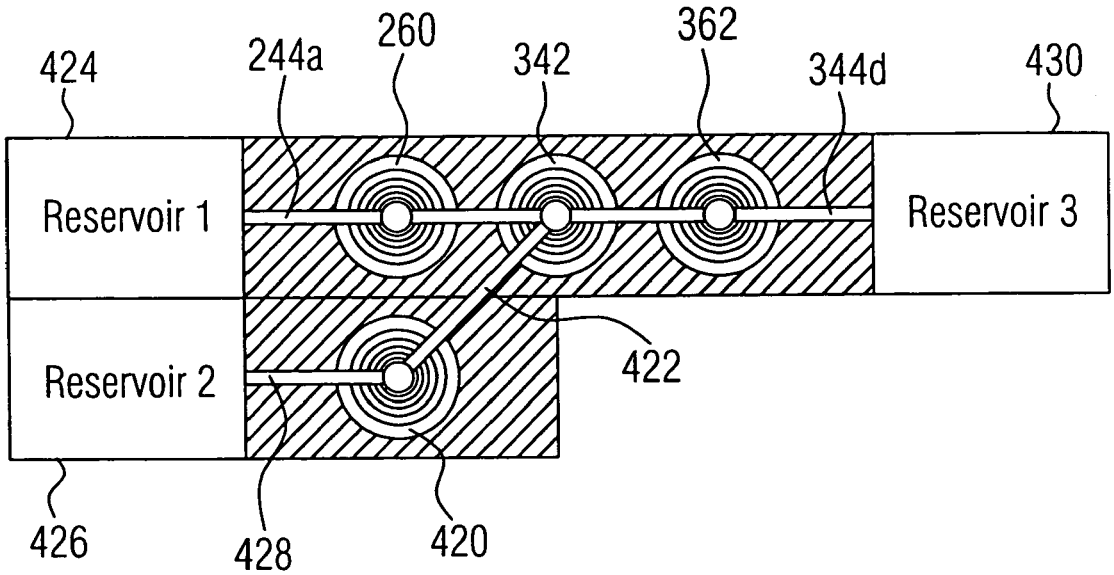
FIG. 15 is a schematic illustrations of an inventive multiple micropump.

A structure with four fluid chambers, as it is shown in FIG. 15, may for example form a branch structure or a mixer, in which the mixing flows may actively be conveyed. The expansion to four fluid chambers with four associated fluid actors enables, as it is for example shown in FIG. 15, the realization of three peristaltic pumps, wherein each pump direction between all reservoirs 424, 426, and 430 may be realized in both directions. With this, it is possible that a single membrane element covers all fluid chambers and reservoir containers, wherein a separate piezo-actor is provided for each fluid chamber. Thus, the entire fluidics may be designed very flat, wherein the functional, fluidic structures including fluid chambers, channels, membranes, piezo-actors, and supporting structures may have an overall height on the order of 200 to 400 μm. Thus, systems are possible, which may be integrated in chip cards. Furthermore, even flexible fluidic systems are possible.

Apart from the embodiments shown, fluid chambers may be arbitrarily interleaved in a plane. Thus, a micro-peristaltic pump each may be associated with different reservoirs, which then for example supply reagents to a chemical reaction (for example in a fuel cell) or perform a calibration sequence for an analysis system, for example in a water analysis.

For the creation of a piezo-membrane converter, the piezo-ceramic may for example be glued on the respective membrane sections. Alternatively, the piezo-ceramics, for example PZT, may be directly applied in thick film technique, for example by screen-printing methods with suitable intermediate layers.

Figure 16:
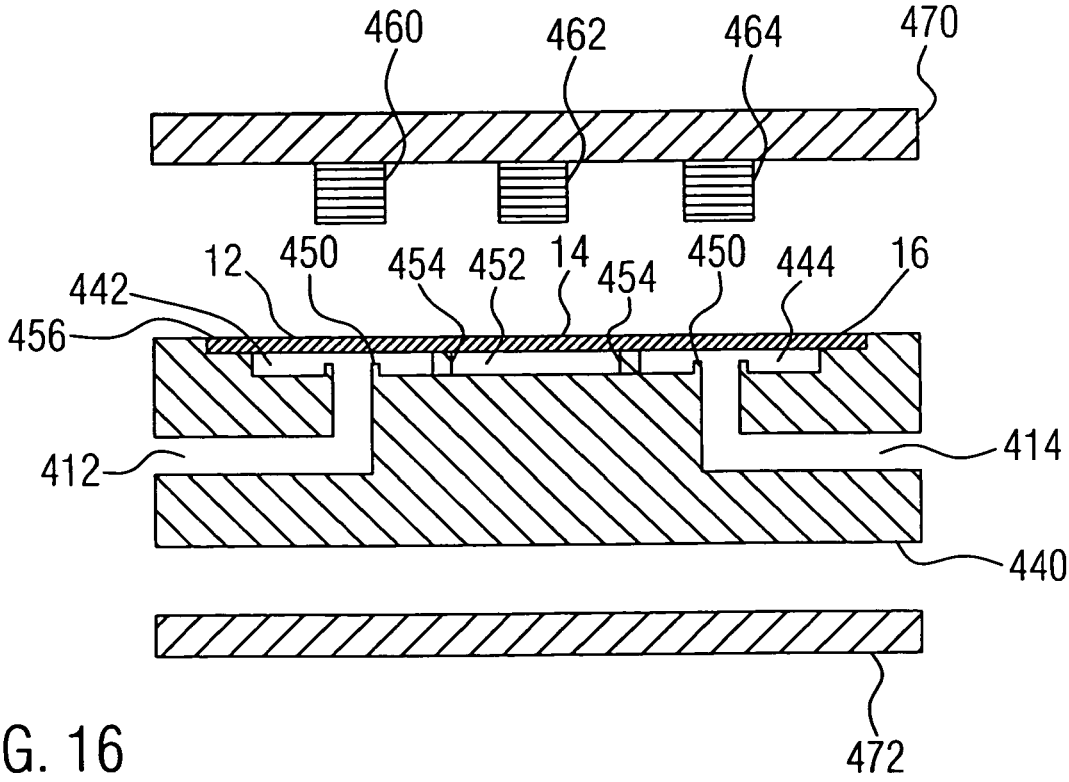
FIG. 16 is a schematic illustration of an alternative embodiment of an inventive micropump.

An alternative embodiment of an inventive micro-peristaltic pump with sunk inlet fluid channel 412 and sunk outlet fluid channel 414 is shown in FIG. 16. The inlet flow channel 412 again leads substantially centrally below the membrane section 12 into a valve chamber 442, wherein the outlet fluid channel leads substantially centrally below the membrane section 16 into a valve chamber 444. The respective mouth openings of the inlet channel 412 and the outlet channel 414 are provided with a sealing lip 450. furthermore, in the pump body 440, a pumping chamber 452 is formed, which is fluidically connected to the valve chambers 442 and 444 by fluid channels in walls 454. According to the embodiment shown in FIG. 16, the three membrane sections 12, 14, and 16 again form a membrane element 456. In this embodiment, the membrane sections, however, are driven by piezo-stack actors 460, 462, and 464, which may be placed on the corresponding membrane sections. To this end, the piezo-stack actors are used using suitable housing parts 470 or 472 shown in FIG. 16 remote from the pump body and the membrane element.

Piezo-stack actors are advantageous in that they do not have to be fixedly connected to the membrane element, so that they enable a modular construction. In such not fixedly connected piezo-stack actors, the actors do not actively pull back a membrane section, when an actuation thereof is ended. A reverse movement of the membrane section can rather only take place by the return force of the elastic membrane itself.

The inventive peristaltic micropumps may be fabricated using most varied production materials and production techniques. The pump body may for example be produced from silicon, fabricated from plastics by injection molding, or produced by precision-engineering cutting. The membrane element forming the drive membrane for the two valves and the pumping chamber may be produced from silicon, may be formed by a metal foil, for example stainless steel or titanium, may be formed by a plastic membrane fabricated in two-component injection molding technique provided with conductive coatings, or may be realized by an elastomer membrane.

The connection of membrane element and pump body is an important issue, because at this connection high shear forces may occur in the operation of the peristaltic pump. For this connection, the following requirements are to be made:

- tight;
- thin joining layer (<10 μm), because the pumping chamber height is a critical design parameter influencing the dead volume;
- mechanical endurance; and
- chemically resistant against media to be conveyed.

In the case of silicon as basic structure and membrane element, silicon fusion bonding without joining layer may take place. In the case of a silicon glass combination, anodic bonding may preferably be used. Further possibilities are eutectic wafer bonding or wafer gluing.

If the basic structure consists of plastic, and the membrane element is a metal foil, laminating may be performed, when a primer is used between membrane element and basic structure. Alternatively, gluing with a glue of high shear strength may take place, wherein then preferably capillary stop trenches are formed in the basic structure to avoid intrusion of glue in the fluid structure.

If both membrane element and pump body consist of plastic, ultrasound welding may be used for the connection thereof. If one of the two structures is optically transparent, alternatively laser welding may take place. In the case of an elastomer membrane, the sealing properties of the membrane may further be used to guarantee sealing by clamping.

In the following it will be briefly explained how a possible mounting of the membrane to the pump body may take place in an inventive microperistaltic pump. In the inventive micropump, if the membrane is glued to the pump body, it should be noted that the dosage of joining layer materials (e.g. glue) is critical, because on the one hand the membrane has to be tight all round (i.e. sufficient glue has to be applied) and on the other hand an intrusion of excess glue in the fluid chambers is to be avoided.

The joining layer material, which may be a glue or an adhesive, is applied on the joining layer e.g. by dispensing or by a correspondingly shaped stamp. After the application of the joining layer material, the membrane is loaded on the basic body. Possible burrs, which may e.g. be at the edge of the membrane when dicing, find space in a corresponding receptacle for the burr, so that a defined location of the membrane is ensured, in particular in the direction perpendicular to the surface thereof, which is important with reference to the dead volume and tightness.

Then it is pressed on the pump body with a stamp so that the glue layer remains as thin and defined as possible. In order to accommodate excess glue, a capillary stop trench may be provided surrounding the fluid areas formed in the pump body. Thus, such excess glue cannot reach the fluid chambers. Under these conditions, the glue may cure in a defined and thin manner. The curing may take place at room temperature or in an accelerated manner in the oven or by UV radiation using UV-curing glues.

Alternatively to the gluing technique described, partially solving the basic body or pump body by suitable solvents and joining of a plastic membrane to the basic body may take place as connection technique.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. Peristaltic micropump comprising:

a first membrane region with a first piezo-actor for actuating the first membrane region;

a second membrane region with a second piezo-actor for actuating the second membrane region;

a third membrane region with a third piezo-actor for actuating the third membrane region; and a pump body, wherein the pump body forms, together with the first membrane region, a first valve whose passage opening is open in the non-actuated state of the first membrane region and whose passage opening may be closed by actuating the first membrane region, wherein the pump body forms, together with the second membrane region, a pumping chamber whose volume may be decreased by actuating the second membrane, and wherein the pump body forms, together with the third membrane region, a second valve whose passage opening is open in the non-actuated state of the third membrane region and whose passage opening may be closed by actuating the third membrane region, wherein the first and second valves are fluidically connected to the pumping chamber.

2. Peristaltic micropump of claim 1, wherein between a stroke volume $\Delta V$ a dead volume $V_0$, a delivery pressure $P_F$, and the atmospheric pressure $P_0$ the following relationship applies:

$$\Delta V/V_0 > P_F/P_0,$$

wherein the stroke volume $\Delta V$ is a volume displaced by an actuation of the second membrane region, wherein the dead volume $V_0$ is a volume present between the opened passage opening of one of the valves and the closed passage opening of the other of the valves in the actuated state of the second membrane region, and wherein the delivery pressure $p_F$ is the pressure necessary in the pumping chamber to move a liquid/gas interface past a bottleneck in the peristaltic micropump.

3. Peristaltic micropump of claim 1, wherein between the first membrane region and the pump body a first valve chamber is formed, and wherein between the third membrane region and the pump body a second valve chamber is formed, wherein the valve chambers are fluidically connected to the pumping chamber.

4. Peristaltic micropump of claim 3, wherein the volume of the pumping chamber is greater than the volume of the first or second valve chamber.

5. Peristaltic micropump of claim 4, wherein a distance between membrane surface and pump body surface in the region of the pumping chamber is greater than in the region of the valve chamber.

6. Peristaltic micropump of claim 4, wherein the second membrane region and the pumping chamber are greater in area than the first or third membrane region and the associated valve chambers.

7. Peristaltic micropump of claim 3, wherein the membrane regions are formed in a membrane element, wherein the valve chamber, the pumping chamber, and fluid channels are formed between the valve chambers and the pumping chamber by structures in the pump body and/or the membrane element.

8. Peristaltic micropump of claim 3, wherein the pumping chamber and the valve chamber have structures in the pump body, wherein the contours of the structures are adapted to the respective arched contour of the corresponding membrane section in the actuated state.

9. Peristaltic micropump of claim 8, comprising lateral fluid feed lines to the valve chambers formed in the pump body, which are closed by actuating the corresponding membrane section.

10. Peristaltic micropump of claim 9, wherein, in the region of a valve chamber, a ridge is provided against which the corresponding actuated membrane section abuts to close the corresponding lateral fluid line.

11. Peristaltic micropump of claim 9, wherein the valve chambers comprise, opposite the corresponding membrane section, a plastically deformable material against which the corresponding membrane section abuts in the actuated state.

12. Peristaltic micropump of claim 1, wherein the pumping chamber has a structure in the pump body, wherein the contour of the structure is adapted to the arched contour of the second membrane section in the actuated state.

13. Peristaltic micropump of claim 1, wherein the first and the third membrane region and the piezo-actors thereof are designed such that they push on a counter-element with a predetermined force in the actuated state to close the respective valve.

14. Peristaltic micropump of claim 1, further comprising at least one further membrane region with a further piezo-actor for actuating the further membrane region, the further membrane region forming, together with the pump body, a further valve whose passage opening is open in the non-actuated state of the further membrane region and whose passage opening may be closed by actuating the further membrane region, the further valve being fluidically connected to the pumping chamber.

15. Peristaltic micropump of claim 1, wherein the piezo-actors are piezo-membrane converters formed by respective piezo-elements applied onto a membrane region.

16. Peristaltic micropump of claim 15, wherein the piezo-elements are glued onto the respective membrane region or formed on the respective membrane region in thick film technique.

17. Peristaltic micropump of claim 1, wherein the piezo-actors are formed by respective piezo-stacks.

18. Fluid system with a plurality of peristaltic micropumps of and a plurality of reservoirs fluidically connected to the peristaltic micropumps, a first membrane region with a first piezo-actor for actuating the first membrane region;

a second membrane region with a second piezo-actor for actuating the second membrane region;

a third membrane region with a third piezo-actor for actuating the third membrane region; and a pump body, wherein the pump body forms, together with the first membrane region, a first valve whose passage opening is open in the non-actuated state of the first membrane region and whose passage opening may be closed by actuating the first membrane region, wherein the pump body forms, together with the second membrane region, a pumping chamber whose volume may be decreased by actuating the second membrane, and wherein the pump body forms, together with the third membrane region, a second valve whose passage opening is open in the non-actuated state of the third membrane region and whose passage opening may be closed by actuating the third membrane region, wherein the first and second valves are fluidically connected to the pumping chamber.

* * * * *